US005934537A

United States Patent [19]

Miller

[11] Patent Number: 5,934,537

[45] Date of Patent: Aug. 10, 1999

[54] DEVICE FOR PUSHING OR PULLING USING GRIPPING

[76] Inventor: James Edwin Miller, 22 Talcott Mountain Rd., Simsbury, Conn. 06070

[21] Appl. No.: 09/010,913

[22] Filed: Jan. 22, 1998

Related U.S. Application Data

[60] Provisional application No. 60/037,662, Jan. 22, 1997.

[51] Int. Cl.[6] ..... B65H 20/00; E21B 19/00

[52] U.S. Cl. ..... 226/182; 226/90; 226/186; 254/30; 166/77.1

[58] Field of Search ..... 226/182, 186, 226/177, 90, 181; 254/30, 226, 333, 382, 362; 166/77.1

[56] References Cited

U.S. PATENT DOCUMENTS

| | | | |
|---|---|---|---|
| 598,527 | 2/1898 | Michael | 254/30 |
| 1,387,944 | 8/1921 | Price | 254/30 |
| 2,603,343 | 7/1952 | Payne | 226/182 |
| 2,820,607 | 1/1958 | Dawes | 254/30 |
| 3,318,005 | 5/1967 | Petersen . | |
| 3,376,933 | 4/1968 | Burlet . | |
| 3,447,730 | 6/1969 | Jeannette | 226/182 X |
| 3,589,580 | 6/1971 | Smulders . | |
| 3,791,625 | 2/1974 | Viljoen . | |
| 3,866,882 | 2/1975 | Willm et al. . | |
| 3,871,618 | 3/1975 | Funk . | |
| 5,253,845 | 10/1993 | Wilbert . | |

OTHER PUBLICATIONS

American Society for Metals; Metals Handbook; Metals Handbook, 8th edition; Jan. 01, 1999; pp. 347–350

*Primary Examiner*—Michael Mansen
*Attorney, Agent, or Firm*—Roylance, Abrams, Berdo & Goodman, L.L.P.

[57] ABSTRACT

Lateral elastic deformation of Drive wheels (12) is used to grip and to push or pull elongated members by powered rotation of Drive wheels (12). This arrangement allows two wheels on a single shaft to be used in place of more cumbersome arrangements of multiple shafts and their support and drive systems as is used when the elongated members are contacted by the peripheries of the tires. The device Is also modular allowing the prime mover and initial gear reductions (Portable Power Drive (13)), the Drive wheel Assembly (20), and the attachment to the primary support to be installed as units.

20 Claims, 3 Drawing Sheets

DEVICE FOR PUSHING OR PULLING USING GRIPPING

CROSS REFERENCE TO RELATED APPLICATIONS

This application claims the benefit of U.S. Provisional Patent Application number 60/037,662 entitled Modular Device for Pushing or Pulling Using Friction from Lateral Force Developed by Two Adjacent Elastic Tires filed Jan. 22,1997.

BACKGROUND—FIELD OF THE INVENTION

This invention relates to transporting elongated members, specifically by developing a gripping force between wheels and the driven elongated member.

BACKGROUND—DESCRIPTION OF PRIOR ART

A tractive force developed from friction between the elongated member and wheels or moving tracks is often used in order to move elongated members using great force. An embodiment of this method of moving elongated members is the use of friction wheels to remove or replace pipes in wells.

Funk (U.S. Pat. No. 3,871,618) uses three wheels, two of which contact well pipe at their peripheries, at 90 degree angles and are powered. The 90 degree orientation of the powered wheels necessitates bearings and a shaft for each of the two wheels as well as a set of gears to transfer driving power to both shafts. A third wheel pushes the well pipe into the driven wheels. The aforementioned third wheel is also attached to a large framework which is inserted into the main framework of the apparatus when in use. The pipe or driven member contacts all wheels at their peripheries only. The prime mover and all gear reductions are securely mounted on the large rigid framework and remain mounted during set up and operation.

Viljoen (U.S. Pat. No. 3,791,625) utilizes two slanted contact surfaces on a single shaft (the sides and smaller outside diameter of the sheave) and a presser wheel to haul a fishing net. The presser wheel drives the fishing net into the sheave and the sheave is driven. Tractive force arises from friction from the contact between the fishing net and the sheave. The presser wheel provides a normal force which increases the contact force and therefore the friction force between the fishing net and the sheave. The sheave is a rigid member and does not conform to the net which is itself elastic and conforms to the rigid sheave contact surfaces. Additionally, the system of the sheave, the drive and the presser wheel are all mounted on a single framework and moved as one unit when used for the intended purpose.

Burlett (U.S. Pat. No. 3,376,933) uses his apparatus for moving a well pipe but does so with two elastic wheels whose peripheries press against the pipe. The wheels are held in place for moving the well pipe by a hinge and a threaded member connecting their axles. The length of the threaded member can be changed to increase the contact force between the wheels and the pipe. Burlett makes the drive and gear reductions an integral part of the apparatus. Recognizing that the complete apparatus is thus quite heavy and cumbersome, Burlett allows one wheel to swing about a hinge point and be locked into position to turn the apparatus into a trailer.

Devices using the periphery of tires or wheels are common in other applications as well. One embodiment is shown in Metals Handbook, 8th edition by American Society for Metals in which the wheels are used to transport wire for forming purposes. The periphery of the wheels or tires is used to drive the wire members. The power system and associated gear reductions, although not shown in the article in the handbook, are an integral part of the machine which also includes the drive wheels.

Wilbert (U.S. Pat. No. 5,253,845) uses driven belts in contact with a well pipe in order to develop a tractive force to move the well pipe. The belts are arranged on hinged supports in order to swing into contact with the well pipe, or to swing out of the way for access to the well casing. In either case the drive belts, their supports, all necessary gear reductions and the prime mover are attached to a substantial base structure which is moved as a unit to the well site for well pipe installation or removal.

Machines such as described above all serve to move elements with friction developed by contact with the peripheries of a grouping of driving wheels, by contact with rigid lateral surfaces as in the sheave of the fish net hauler or by contact with the outer surfaces of belts. These machines all incorporate their mounting provisions and drives as inseparable parts of the main machine.

Among the uses of apparatus to move linear members are removal or replacement of well pipe and well pumps, and removal or replacement of wires or cables in a conduit. In each of these uses as well as many others, the apparatus is moved to and from the job site frequently. The job site is often difficult to access and may be high in the air. In these situations of difficult access, compactness of the apparatus, portability and ease of set up and take down are substantial advantages. In the absence of access difficulties, light and compact apparatus remains advantageous by increasing ease of transport and use. Heretofore, arrangements of driving members and prime movers have resulted in apparatus that is cumbersome for moving to the job site and setting up for the intended purpose. The size of these arrangements is driven by the configuration of the driving wheels, sheaves or belts, and the mounting of these components, as well as the prime mover and associated speed reduction machinery into a single apparatus which becomes large and cumbersome. As an example of this arrangement limitation, consider U.S. Pat. No. 3,871,618 to Eldon E. Funk in which the driving wheels are each on separate shafts supported by their own bearings and torsionally connected by gears on each shaft. The driving wheels, together with a motor, gearboxes and chains and sprockets are mounted on a single framework which also serves to support the system and attach it to a well casing. The resultant system is large and cumbersome and makes the machine's set up and use difficult at hard to access job sites.

OBJECTS AND ADVANTAGES

Accordingly, several objects and advantages of the present invention are:

To provide an improved arrangement of the basic drive wheel assemblies which results in a compact design.

To allow my invention to be set up in modules which are themselves compact and which assemble easily so that the apparatus can be moved not in one or two large heavy parts but in several compact light weight parts.

The drive wheels on the present invention are on the same shaft and are elastically deformable in a lateral direction. Positioning of the drive wheels on a single shaft in this manner allows the drive wheels to be deformed laterally when the driven elongated member is forced between them.

When the driven elongated member is forced between the drive wheels, the elastic lateral deformation of the drive wheels results in a pinching force and a wedging action that combine to grip the elongated member securely. When the drive wheels are forced to turn a tractive force results which causes the elongated member to move. By arranging the drive wheels on the same shaft in this manner and using the lateral elastic deformation of the wheels to grip the elongated member, the need for separate bearings, shafts and drives for each wheel is eliminated. The resultant savings in machinery and the support system for that machinery allows the present invention to be substantially more compact and light weight than previous inventions. Since users often move equipment from job site to job site and since job sites may be difficult to access, compactness, light weight and ease of portability are substantial advantages.

The present invention is modular and has separable devices each of which is compact and light weight. The devices are easily attached to one another to allow assembly on the job site. The easy attachment facilitates ease of set up and use of the machine. These devices are as follows:

- A separate mount system for attaching the present invention to the basic support member such as a well casing or electrical conduit.
- A separate drive wheel assembly including drive wheels and a final speed reduction, if necessary.
- A separate prime mover which includes initial speed reductions.
- A separate wheel which forces the elongated member between the drive wheels and may itself become torsionally connected to the drive wheels by forcible contact with them.

Reference to use of the present invention in the embodiment of a machine to remove and install well pipe serves as an example of the advantage of compact and modular nature of the arrangement of the components. The basic support member, or well casing in the case of this embodiment can be far away from access roads, across rugged terrain and may even be a substantial distance up in the air. Additionally for aesthetic or functional reasons the casing can be in a pit, in the crawl space under a building, or surrounded by a structure impeding access.

In these and other cases the user must transport, often by carrying, the apparatus to the job site. The more large, heavy and cumbersome the apparatus, the more difficult becomes the task of moving the apparatus to the job site and setting it up for use. Light, modular components as in the present invention not only make the transport of the apparatus to the job site far easier but also make set up easier and safer because the user is handling small, lightweight components.

Still further objects and advantages will become apparent from a consideration of the ensuing description and accompanying drawings.

SUMMARY

A modular apparatus for moving elongated members in which the elongated member is gripped by friction resulting from a reaction to the elastic lateral deformation of two adjacent tires on the same shaft and the elongated member is caused to move when the wheels turn. The use of two tires on the same shaft allows the apparatus to be compact and economical because additional shafts and bearings for drive wheels contacting the elongated member and at various angles are not needed. Further, the apparatus is modular so that the prime mover and initial speed reduction machinery, the drive wheel system and the means for attachment to the primary housing for the elongated member are all separable. The modular and separable nature of this apparatus permits ease of transport and installation for uses in which larger more cumbersome apparatus that cannot be separated into smaller, lighter components is very difficult or even dangerous to use.

Preferred Embodiment—Description

Figure 1:
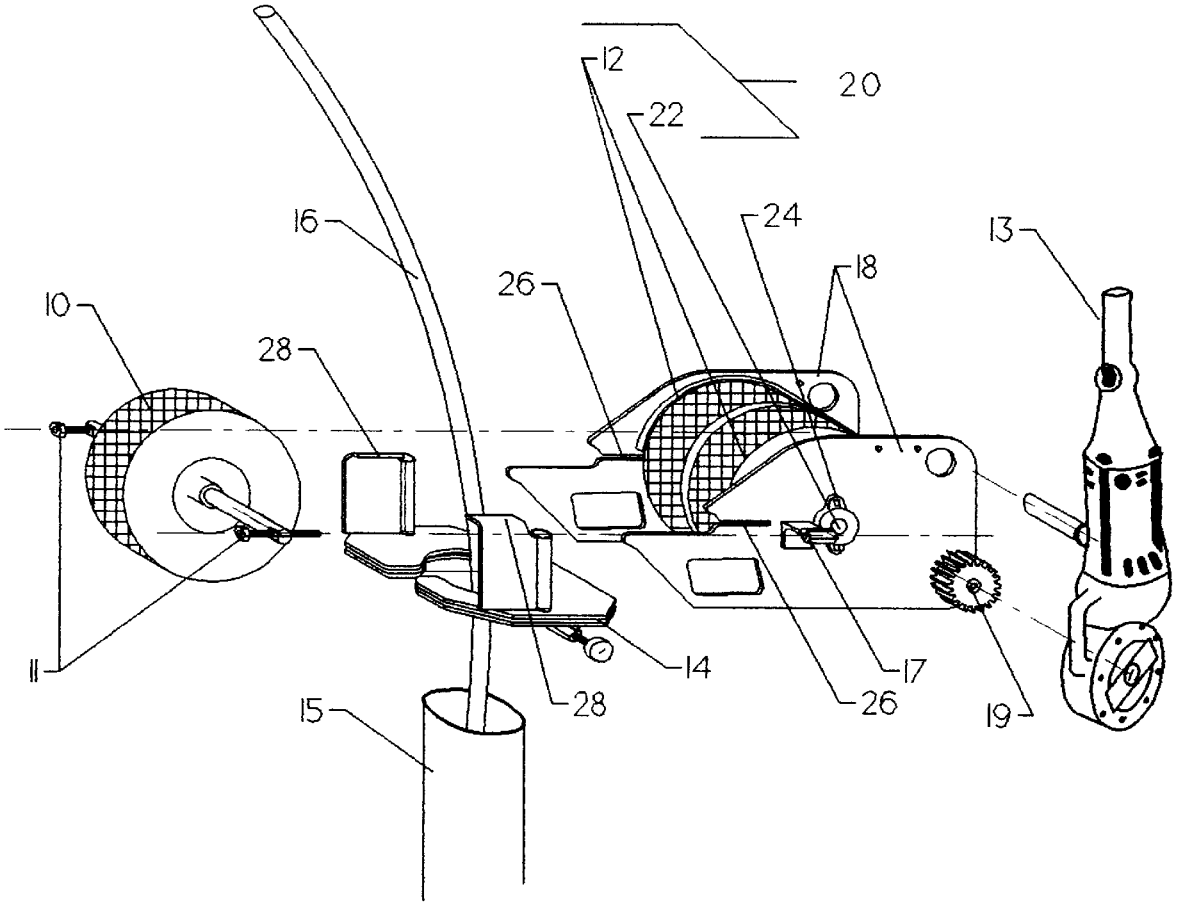
FIG. 1 is a view showing how the modular components fit together in the embodiment of a well pump puller.

FIG. 1 shows how the modular components fit together during set up in the embodiment of a well pipe puller.

Figure 2:
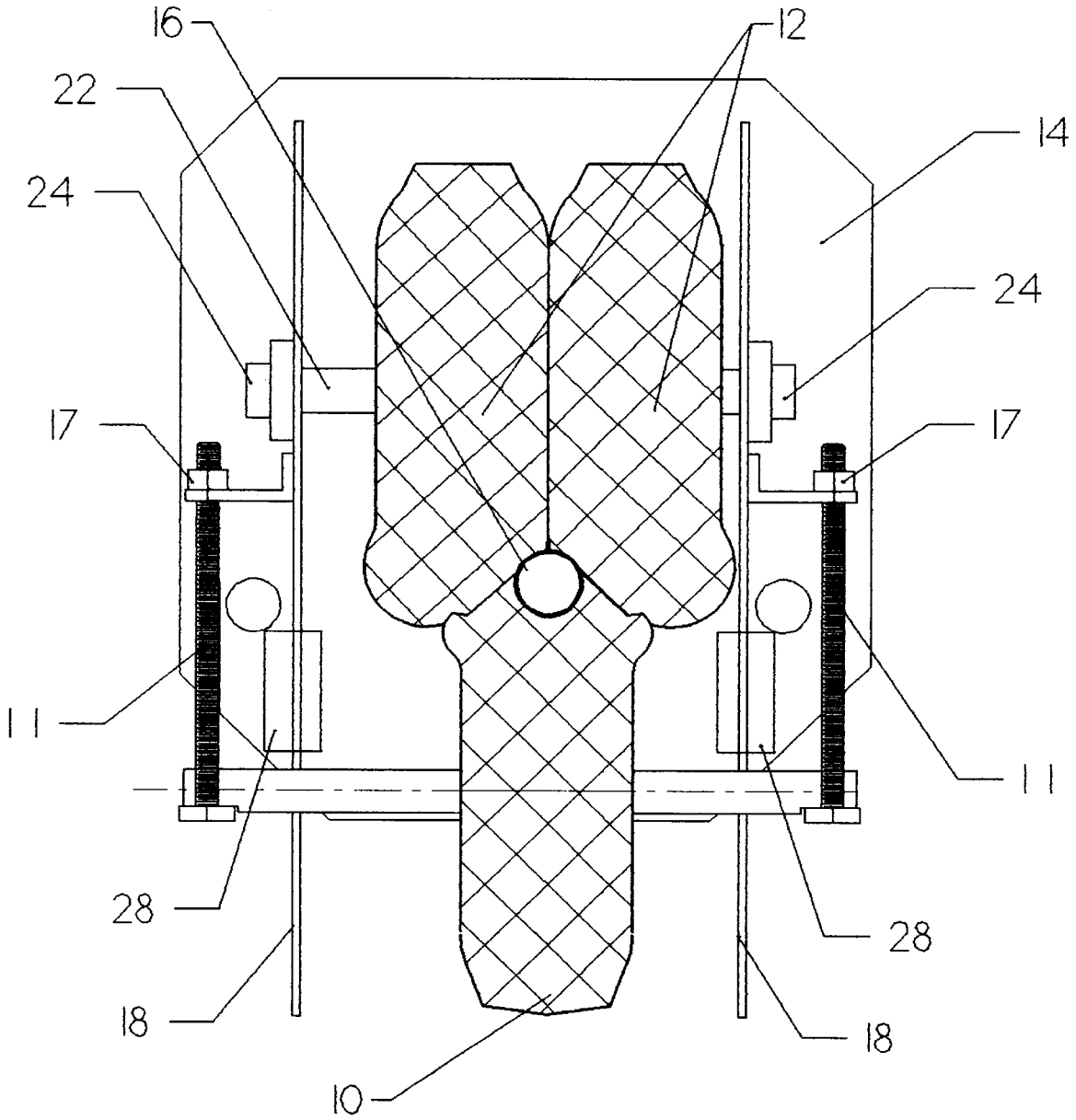
FIG. 2 is a view showing the lateral displacement of two adjacent elastic tires on the same shaft producing the clamping force developed on the elongated member by the drive wheel arrangement.

FIG. 2 shows the arrangement of the modular components when assembled in the embodiment of a well pipe puller.

Figure 3:
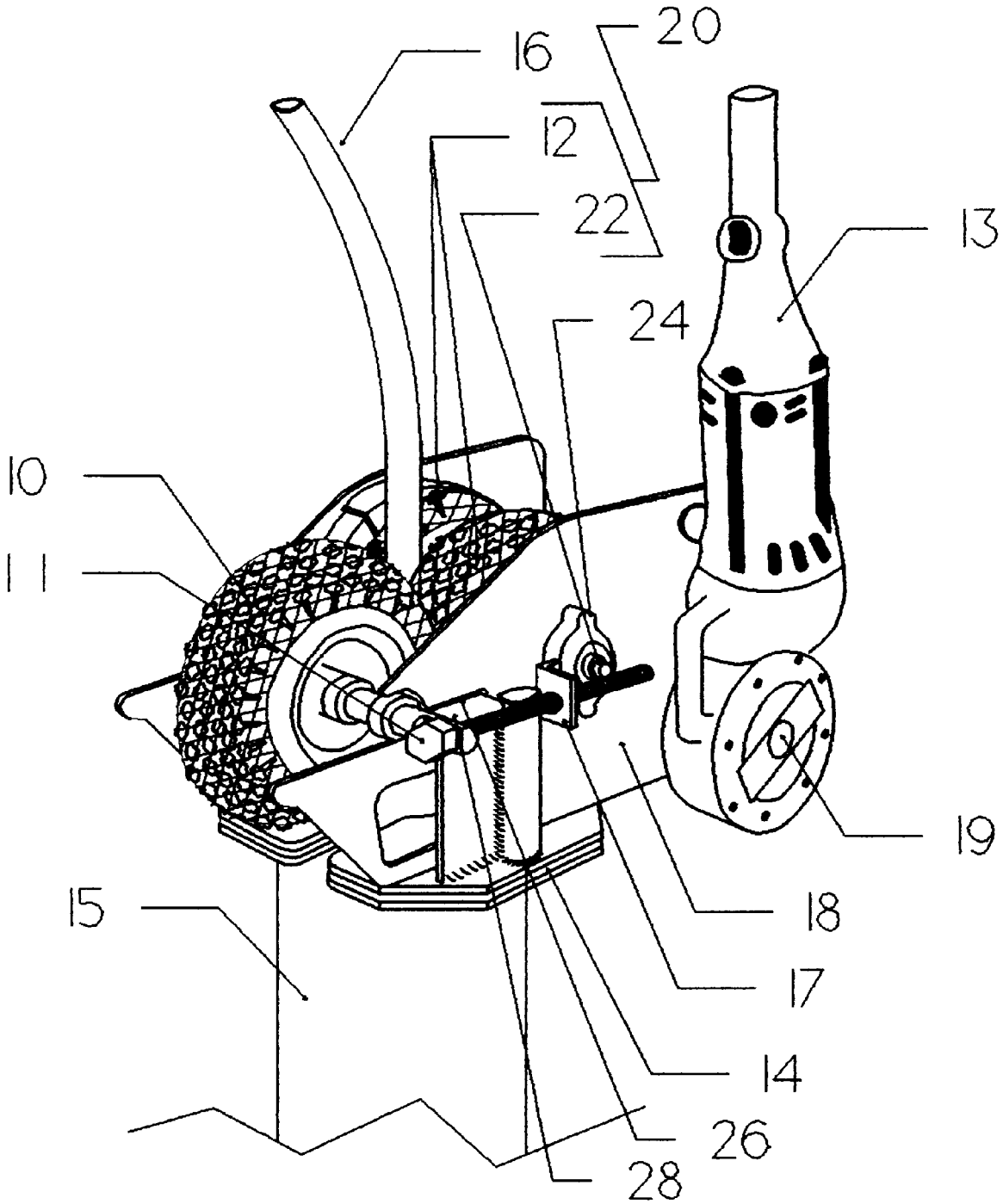
FIG. 3 is a view showing the assembly of the modules into the working apparatus.

FIG. 3 shows arrangement of the driving wheels and the pinching wheel.

Preferred Embodiment—Operation

A typical embodiment of the present invention is shown in which the modules are assembled on a well casing for purposes of pulling a well pipe.

In FIG. 1, the Well Casing 15 houses the Well Pipe 16 and provides a convenient mount point for the apparatus. The Base 14 securely mounts onto the Well Casing 15 by any of a variety of means. For example, the Base 14 could have mounted on it several threaded members which advance radially and contact the Well Casing 15 periphery when rotated. The size of the Base 14 as well as its configuration permit unobstructed access to the inside of the Well Casing 15.

The Drive Wheel Assembly 20 is next installed on the Base 14 which has provision for locating the Drive Wheel Assembly 20 correctly over the casing and automatically attaching to it in a manner that prevents the Drive wheel Assembly 20 and subsequent modular components from tipping over and falling off the Base 14. This provision consists of a Base to Sideplate Engagement Tang 28 on the Base 14 and a mating Sideplate Slot for Base to Sideplate Engagement 26 into which the Base to Sideplate Engagement Tang 28 slides and engages.

The Drive wheel Assembly 20 consists of two Drive wheels 12 mounted on a Single Axle 22. The Single Axle 22 is supported by Drive Wheel Shaft Support Bearings 24 which mount on Sideplates 18. An example of the Drive Wheels 12 in the preferred embodiment for gripping and moving Well Pipe 16 up to 2.5 inches in outside diameter is pneumatic rubber tires approximately 10 inches in diameter which are inflated to 25–35 pounds per square inch pressure. In the preferred embodiment for gripping and moving Well Pipe 16, the Drive wheels 12 are mounted on the Single Axle 22 so that their rims touch and are held in that position by suitable means such as collars clamping on the shaft or adhesive that bonds the wheel rim inside diameters to the shaft. Since the sides of the Drive wheels 12 extend axially beyond the rims of the Drive Wheels 12 in the free state, the sides of the Drive Wheels 12 press tightly against each other when the rims are held as described and more tightly still when the Drive wheels 12 are inflated as described.

The two additional modules, Portable Power Drive 13 and Pinch Wheel Assembly 10 are then added to the apparatus in any convenient order.

The Pinch Wheel Assembly 10 has a single wheel which in the preferred embodiment for gripping and moving Well Pipe 16 up to 2.5 inches in outside diameter is a pneumatic rubber tire approximately 10 inches in diameter and inflated to 25–35 pounds per square inch pressure. The Pinch Wheel Assembly 10 is forceably driven against the Well Pipe 16 which drives the Well Pipe 16 between the Drive Wheels 12 to accomplish the gripping described previously. The Pinch Wheel Assembly 10 may be installed and driven into position by any of a variety of methods such as Pinch Wheel Clamp Bolts 11 on either end of the axle of the Pinch Wheel Assembly 10 which for example in this embodiment are long threaded members and which screw into Pinch Wheel Clamp Nuts 17. The Pinch wheel Clamp Nuts 17 are arranged on either side of the Drive Wheel Assembly 20. Screwing the Pinch Wheel Clamp Bolts 11 into the Pinch Wheel Clamp Nuts 17 drives the Well Pipe 16 into the Drive Wheel Assembly 20 in a manner that forces the lateral deformation of the Drive Wheel Assembly 20 which in turn securely grips the Well Pipe 16. The lateral deformation is shown in FIG. 2 and discussed in detail below.

The Portable Power Drive 13 may be installed on the Input Driveshaft 19 by a variety of means. One of these means employs a Portable Power Drive 13 commonly used in the plumbing trade for driving pipe dies. Such a Portable Power Drive 13 is the Rigid R700 made by the Ridge Tool Company, Elyria Ohio. This particular example of a Portable Power Drive 13 attaches to the Input Driveshaft 19 with teeth which engage spline teeth on the Input Driveshaft 19. Installation of the Portable Power Drive 13 in this manner allows easy installation of the Portable Power Drive 13 as the module of the present invention. Torque generated by the Portable Power Drive 13 is reacted by an arm which may be integral with either the Sideplates 18 or the Portable Power Drive 13 and which slides into the opposite member when the Portable Power Drive 13 is installed. In the embodiment of this invention using the Rigid R700, the arm is integral with the Portable Power Drive 13 and engages a hole in the Sideplates 18.

When the Pinch Wheel Assembly 10, the Drive Wheel Assembly 20, and the Portable Power Drive 13 are assembled on the Base 14, the apparatus is in place and ready to cause the Well Pipe 16 to move either into or out of the Well Casing 15. Powering the Portable Power Drive 13 in the appropriate direction causes the Well Pipe 16 to move into or out of the well casing.

A similar arrangement of modular components would be useful for other embodiments in which elongated members are moved such as the installation and removal of electrical wires and other cables from conduits, hauling fish nets, and moving materials of suitable shape for example lumber.

The method by which the present invention engages the elongated member in order to produce a substantial tractive force and move the elongated member when the wheels turn is described next.

The Drive Wheels 12 are elastically deformable as would happen in this embodiment with rubber pneumatic tires. The Pinch wheel Assembly 10 forces the Well Pipe 16 between the Drive Wheels 12. This action deforms the Drive Wheels 12 laterally and the reaction to this deformation is a substantial gripping force on the Well Pipe 16 and a large area of contact between the Drive Wheels 12 and the Well Pipe 16. The gripping force from lateral deformation of the Drive Wheels 12 is the basis of the tractive force developed between the Drive Wheels 12 and the Well Pipe 16 when the Drive Wheels 12 are caused to turn.

FIG. 2 shows a view looking at the end of the elongated member and again the embodiment of a well pipe is used to show the working of the apparatus in the present invention.

Conclusions, Ramifications, and Scope

Accordingly, it can be seen that the present invention provides a means of gripping elongated members by lateral elastic deformation of wheels in contact with the elongated member at the sides of the wheels rather than the peripheries of the wheels. The gripping action from a contact force generated in this manner can then be used to move the elongated member by rotating the wheels. Wheels driving elongated members in this manner of contact can therefore be on a common shaft which allows use in compact arrangements because multiple shafts with their attendant bearings and torque transfer systems are not needed. Since the bearings and torque transfer systems on the drive wheel assembly are not needed, large translational forces can be generated by smaller, more compact and less expensive apparatus.

The present invention also allows a complete apparatus to be made from modular components in which the prime mover and initial gear reductions, the arrangement for attachment to the primary support and the drive wheel system are all separate and separable units. Additionally the prime mover and initial gear reductions are available as a unit that is made for another purpose and in high volume that minimizes cost. These modular components allow an apparatus to be assembled at the work site and on the primary support of the elongated member to be driven. The resultant ability to transport small and light modules, and easily assemble them into a complete machine makes transport, installation and use of the apparatus easier and simpler than with machines in which the main drive system, the prime mover and all intermediate speed reduction machinery are mounted on a single device.

In one embodiment of the present invention, the modular nature of the invention allows well pumps and pipes to be removed and installed in well casing when the well casing is in a craw space under a cottage as is occasionally done in areas where freezing of the well is possible. Previous apparatus for the purpose of removing and replacing the well pipe and pump incorporates all drive machinery and the pipe contact apparatus in a single unit which often is too large and cumbersome to use in this situation. As a result, well pumps and pipe had to be pulled by hand with considerable difficulty and safety risk to the person servicing the well.

Although the description above contains many specificity=3 s, these should not be construed as limiting the scope of the invention but as merely providing illustrations of some of the presently preferred embodiments of this invention. Various other embodiments and ramifications are possible within its scope. For example, the elastic lateral deformation of the drive wheel assemblies can be used to grip and hold static members, to grip and apply translational forces to curved members and to solid bodies by gripping along one edge.

Thus the scope of the invention should be determined by the appended claims and their legal equivalents, rather than by the examples given.

What is claimed is:

1. An apparatus for applying forces to move elongated members said apparatus comprising:

two elastically deformable wheels each of said wheels having a side and each of said wheels mounted on a single shaft for gripping the elongated member by lateral deflection of at least one of said sides of said wheels said lateral deflection resulting from forcing the elongated member between said two elastically deformable wheels.

2. An apparatus according to claim 1 wherein said elastically deformable wheels are pneumatic.

3. An apparatus for applying forces comprising:

a housing having first and second supports and a first axle coupled to and extending between said first and second supports, said first axle extending along a first axis, said first axis extending in a first direction and in a second, opposite direction;

a first wheel mounted on said first axle for rotating about said first axis, said first wheel having a first inner side, a first outer side spaced from said first inner side, and a first annular periphery positioned between and coupled to said first outer and first inner sides;

a second wheel mounted on said first axle for rotating about said first axis, said second wheel having a second inner side, a second outer side spaced from said second inner side, and a second annular periphery positioned between and coupled to said second outer and second inner sides, said first and second wheel being positioned between said first and second supports, said first inner side having a first displaceable portion that is displaceable between a first original position and a first indented position, said first indented position being spaced from said first original position in said first direction, away from said second wheel, and said second inner side having a second displaceable portion that is displaceable between a second original position and a second indented position, said second indented position being spaced from said second original position in said second direction, away from said first wheel; and a pinch assembly coupled to said housing, spaced from said first axle, and positioned opposite said first and second wheels, one of said first axle and said pinch assembly being adjustably movable toward and away from said other of said first axle and said pinch assembly to apply a force on an elongated member, the elongated member being positioned between said pinch assembly and said first and second wheels during the application of the force.

4. An apparatus according to claim 3, wherein said first wheel is a first pneumatic tire and said second wheel is a second pneumatic tire.

5. An apparatus according to claim 4, wherein said first and second tires having first and second rims, respectively, coupling said first and second tires to said first axle, and said first rim directly contacting said second rim.

6. An apparatus according to claim 3, wherein said first support is a first wall having a first slot and said second support is a second wall having a second slot.

7. An apparatus according to claim 6, further comprising:

a mounting base removably coupled to said first and second walls of said housing, said mounting base being removably positioned within said first and second slots.

8. An apparatus according to claim 7, wherein said mounting base has a support element and first and second flanges extending from said support element, said first flange being removably positioned within said first slot of said housing and said second flange being removably positioned within said second slot of said housing.

9. An apparatus according to claim 3, wherein said pinch assembly includes a second axle extending along a second axis and a third wheel mounted on said second axle for rotating about said second axis.

10. An apparatus according to claim 9, wherein said third wheel is a third pneumatic tire having a third rim coupling said third pneumatic tire to said second axle.

11. An apparatus according to claims 10, wherein said second axle has a first end and a second end, said first end of said second axle being adjustably coupled to said first support by a first adjusting element, and said second end of said second axle being adjustably coupled to said second support by a second adjusting element.

12. An apparatus according to claim 3, wherein said first and second wheels are rigidly coupled to said first axle.

13. An assembly comprising in combination:

an apparatus for applying forces having a housing, first and second wheels, and a pinch assembly;

said housing having first and second supports and a first axle coupled to said first and second supports and extending along a first axis, said first axis extending in a first direction and in a second, opposite direction, said first wheel mounted on said first axle for rotating about said first axis, said first wheel having a first inner side, a first outer side spaced from said first inner side, and a first annular periphery positioned between and coupled to said first outer and first inner sides, said second wheel mounted on said first axle for rotating about said first axis, said second wheel having a second inner side, a second outer side spaced from said second inner side, and a second annular periphery positioned between and coupled to said second outer and second inner sides, said second inner side facing said first inner side of said first wheel and facing in said first direction, and said second outer side facing away from said first wheel and facing in said second direction, said pinch assembly coupled to said housing, spaced from said first axle, and positioned opposite said first and second wheels; and an elongated member positioned between said first wheel and said second wheel, said first inner side of said first wheel having a first displaced portion and a first undisplaced portion with said first displaced portion being indented from said first undisplaced portion in said first direction, and said second inner side of said second wheel having a second displaced portion and a second undisplaced portion with said second displaced portion being indented from said second undisplaced portion in said second direction, said elongated member directly contacting said first and second displaced portions, one of said first axle and said pinch assembly being adjustably movable toward and away from said other of said first axle and said pinch assembly to apply a force on said elongated member, said elongated member being positioned between said pinch assembly and said first and second wheels during the application of the force.

14. The assembly according to claim 13, wherein said first outer side of said first wheel has a third displaced portion and a third undisplaced portion with said third displaced portion protruding from said third undisplaced portion in said second direction, said second outer side of said second wheel having a fourth displaced portion and a fourth undisplaced portion with said fourth displaced portion protruding from said fourth undisplaced portion in said first direction.

15. An assembly according to claim 14, wherein said first wheel is a first pneumatic tire and said second wheel is a second pneumatic tire.

16. An assembly according to claim 15, wherein said first and second annular peripheries of said first and second wheels, respectively, are treaded areas.

17. An apparatus for applying forces comprising:

a housing having a first axle extending along a first axis, and first and second supports, said first support coupled to a first end of said first axle and having a first slot and said second support coupled to a second end of said first axle and having a second slot;

at least one wheel mounted on said first axle for rotating about said first axis, said at least one wheel being positioned between said first and second walls;

a mounting base removably coupled to said first and second supports of said housing, said mounting base being removably positioned within said first and second slots; and a pinch assembly coupled to said housing, spaced from said first axle, and positioned opposite said at least one wheel, and one of said first axle and said pinch assembly being adjustably movable toward and away from said other of said first axle and said pinch assembly to apply a force on an elongated member, the elongated member being positioned between said pinch assembly and said at least one wheel during the application of the force.

18. An apparatus according to claim 17, wherein said mounting base has a support element and first and second flanges extending from said support element, said first flange being removably positioned within said first slot of said housing and said second flange being removably positioned within said second slot of said housing.

19. An apparatus according to claim 18, wherein said first and second supports of said housing have first and second edges, respectively, and each of said first and second edges directly contact said mounting base.

20. An apparatus according to claim 17, wherein said at least one wheel comprises two pneumatic tires, each of said pneumatic tires being coupled to said first axle for rotating about said first axis.

* * * * *